US006242866B1

(12) United States Patent
Bianchi

(10) Patent No.: US 6,242,866 B1
(45) Date of Patent: Jun. 5, 2001

(54) ELECTRIC GAS-LIGHTER

(75) Inventor: Raoul Bianchi, Villa Guardia (IT)

(73) Assignee: Miller Europe S.p.A., Milanese via Privata Iseo (IT)

( * ) Notice: Subject to any disclaimer, the term of this patent is extended or adjusted under 35 U.S.C. 154(b) by 0 days.

(21) Appl. No.: 09/307,746

(22) Filed: May 10, 1999

(30) Foreign Application Priority Data

May 12, 1998 (IT) ..... T098A0397

(51) Int. Cl.[7] ..... H05B 37/02

(52) U.S. Cl. ..... 315/209 CD; 361/256; 431/258

(58) Field of Search ..... 315/209 CD, 178, 315/268, 272, 274, 278, 279, 209 M; 431/18, 258, 278, 264; 361/253, 254, 255, 256

(56) References Cited

U.S. PATENT DOCUMENTS 3,824,432 * 7/1974 Gersing ..... 361/256
4,329,628 * 5/1982 Bohan, Jr. ..... 315/209 SC
4,626,196 * 12/1986 Stohrer, Jr. ..... 431/264
5,267,849 * 12/1993 Paciorek ..... 431/6

FOREIGN PATENT DOCUMENTS 0 167 510 1/1986 (EP) .
0 801 267 10/1997 (EP) .
957315A2 * 11/1999 (EP) .
1 551 728 8/1979 (GB) .
1 175 160 7/1987 (IT) .

* cited by examiner

*Primary Examiner*—Don Wong
*Assistant Examiner*—Ephrem Alemu
(74) *Attorney, Agent, or Firm*—Lowe Hauptman Gilman & Berner

(57) ABSTRACT

The electronic circuit of a gas-lighter has an electronic filter inserted between the input terminals of the gas-lighter and a current-discharge generating circuit. The filter has a first pair of resistors located respectively between a first of the input terminals and a first intermediate node, and between a second of the input terminals and a second intermediate node; a capacitor located between the first intermediate node and the second intermediate node; and a second pair of resistors located respectively between the first intermediate node and the current-discharge generating circuit, and between the second intermediate node and the current-discharge generating circuit.

3 Claims, 3 Drawing Sheets

FIG. 2 (PRIOR ART)
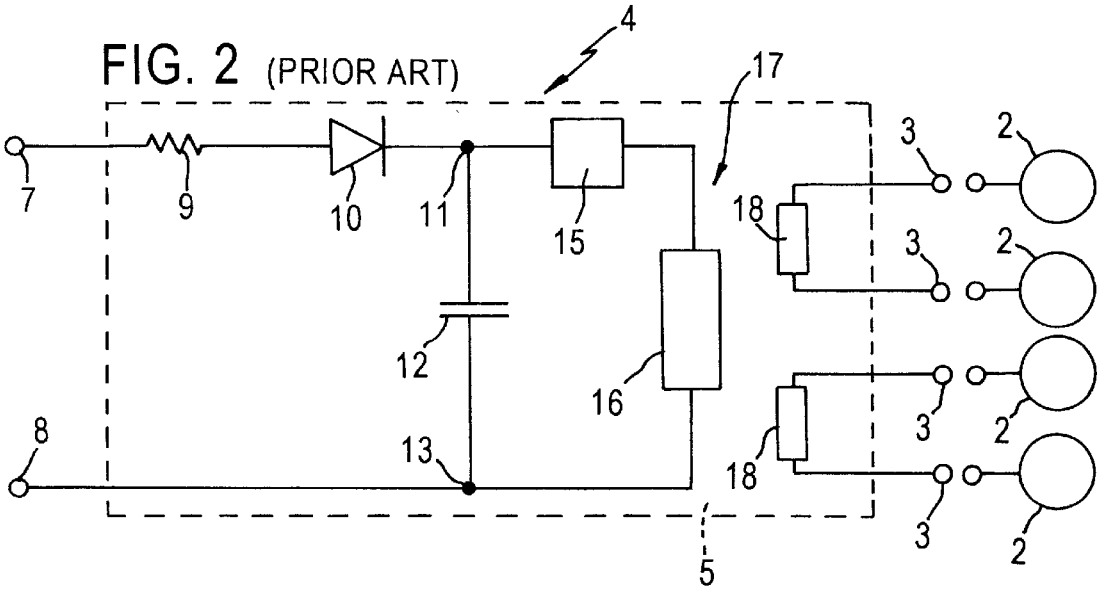
FIG. 4 (PRIOR ART)
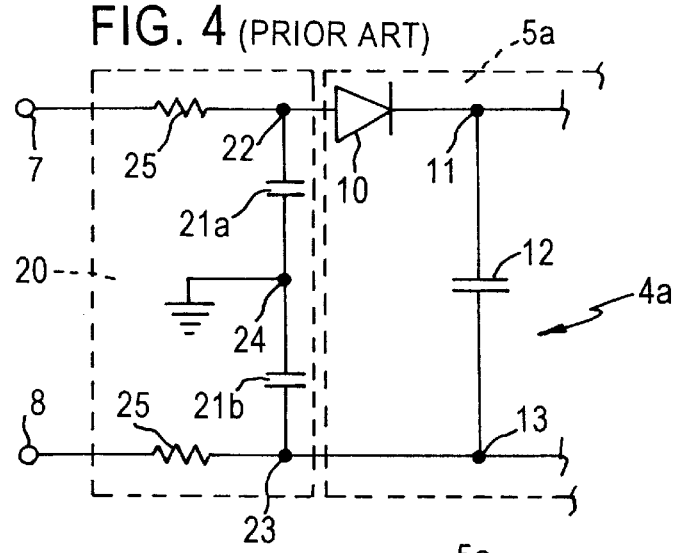
FIG. 1 (PRIOR ART)
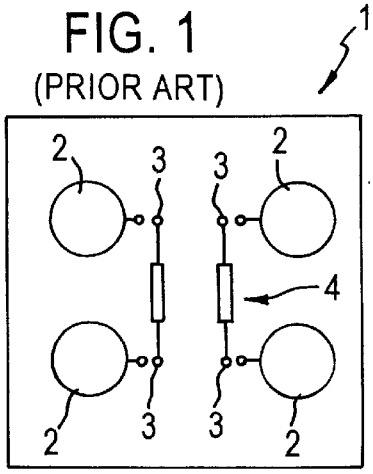
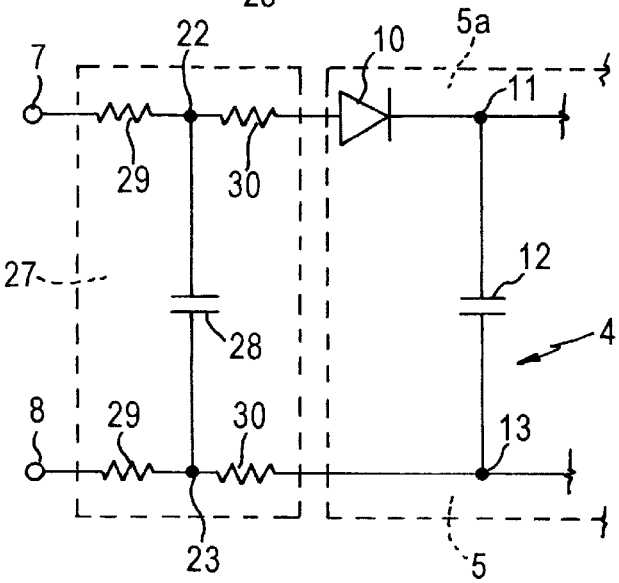
FIG. 5

ELECTRIC GAS-LIGHTER

The present invention relates to an electric gas-lighter, which may be applied, for example, to the cooking range of a gas cooker.

BACKGROUND OF THE INVENTION

Many known modern cooking ranges feature a built-in electric gas-lighter, which is operated manually 64 means of a pushbutton to produce a spark to light the flame.

The most commonly-used ranges with built-in electric gas-lighters are of the type indicated by 1 in FIG. 1, which comprises four gas burners 2 arranged in a square and each flanked by a respective ceramic-coated electrode 3. Electrodes 3 define two pairs of output terminals of an electric gas-lighter 4 shown schematically and only as regards the output circuit. When operated, gas-lighter 4 generates a spark between each electrode 3 and the outer body (grounded together with the entire metal surface of the range) of the corresponding burner 2; and the spark lights the flame of the burner/s 2 supplied with gas.

FIG. 2 shows a complete circuit diagram of a known type of gas-lighter 4.

In addition to electrodes 3, gas-lighter 4 comprises a first and a second input terminal 7, 8 connected to a supply line (not shown); and a current-discharge generating circuit 5 interposed between input terminals 7, 8 and electrodes 3, and for producing the sparks on electrodes 3.

Circuit 5 comprises an input resistor 9 connected to terminal 7; and a rectifying diode 10 having the anode connected to resistor 9, and the cathode connected to a first intermediate node 11.

Circuit 5 also comprises a discharge capacitor 12 located between first intermediate node 11 and a second intermediate node 13 shortcircuited with second input terminal 8; a known voltage discharger 15 (e.g. a Sidac high-energy, solid-state gas tube) parallel with the branch defined by capacitor 12; and, in series with discharger 15, the primary winding 16 of a transformer 17. Transformer 17 also comprises two identical secondary windings 18, each having far more turns than primary winding 16, and the terminals of each of which have a pair of electrodes 3 of the type described above.

Gas-lighter 4 operates as follows.

When the gas-lighter 4 circuit is connected to the supply line, an initial transient state occurs in which capacitor 12 is charged to a threshold voltage value $V_{TH}$ equal to the ignition threshold value of discharger 15, after which, a discharge current Isc of extremely high intensity (e.g. 150–280 A) flows along a discharge path extending through primary winding 16 of transformer 17 and terminating at capacitor 12. At the terminals of primary winding 16, a discharge voltage V1 (e.g. of 400 V) is generated during the discharge transient (lasting a few microseconds) and induces, at the terminals of secondary windings 18, a discharge voltage V2 much higher than V1 (e.g. 28 kV); and, for each secondary winding 18, voltage V2 is sufficient to produce a spark between each electrode 3 and the outer body of respective burner 2, which is accompanied by instantaneous current flow between the two burners 2 of each pair of electrodes 3, and through the metal surface of cooking range 1.

Gas-lighters 4 of the above type have the drawback of generating, during the discharge transient producing the sparks, severe electromagnetic noise above the limits laid down by European standards (EN55014 and following). FIG. 3 shows the result of an electromagnetic compatibility test to determine the voltage value between input terminals 7 and 8 during the discharge transient. The voltage values, expressed in dB$\mu$V, are measured in the 0.15 to 30 MHz frequency range; the regular, substantially horizontal line in the graph indicates the prescribed voltage limit, and the jagged line the measured voltage, which, as can be seen, exceeds the limit over the entire frequency range considered.

One proposed solution to the problem is to fit gas-lighter 4 with an electronic filter to reduce the electromagnetic noise during the discharge transient and so obtain a low-noise gas-lighter 4*a* as shown in FIG. 4. Gas-lighter 4*a* comprises an electronic filter 20 interposed between terminals 7, 8 and a circuit 5*a* equivalent to circuit 5 but having no resistor 9. Filter 20 comprises two capacitors 21*a* and 21*b* located between a node 22 connected to the anode of diode 10, and a node 23 shortcircuited with node 13. More specifically, capacitors 21*a* and 21*b* are located between respective nodes 22 and 23 and a common node 24 which is the ground. Filter 20 also comprises a pair of decoupling resistors 25 towards the mains, a first of which is located between input terminal 7 and node 22, and a second of which is located between input terminal 8 and node 23. Filter 20 defines a preferential path by which to discharge the energy produced during the transient state. More specifically, said energy is conveyed by capacitors 21*a* and 21*b* directly towards ground to reduce the electromagnetic emissions emitted by the circuit.

Though filter 20 indeed provides for reducing the noise level generated during operation to well below the prescribed limit, gas-lighter 4*a* fitted with filter 20 is not without further drawbacks.

First, the ground connection of capacitors 21*a* and 21*b* may result in the entry into the gas-lighter 4*a* circuit of electromagnetic noise generated by other electric devices and traveling along the ground lines, or of the discharge energy at electrodes 3. Second, though minimum for each gas-lighter 4*a*, the expense of providing a ground cable is far from negligible on a mass-production scale, as in the household appliance industry.

SUMMARY OF THE INVENTION

It is an object of the present invention to provide an electric gas-lighter which is highly straightforward, and which provides for eliminating the drawbacks associated with gas-lighters of the type described above.

According to the present invention, an electric gas-lighter comprises a filter interposed between a pair of input terminals and a current discharge generating circuit for generating current discharges and cooperating with at least one input terminal to generate sparks as a consequence of the generation of the current discharges. The filter has no circuit elements connected to a reference potential, advantageously eliminating ground connections to simplify construction.

BRIEF DESCRIPTION OF THE DRAWINGS

A non-limiting embodiment of the present invention will be described by way of an example with reference to the accompanying drawings, in which:

FIG. 1 shows, schematically, the cooking range of a gas cooker featuring an electric gas-lighter;

FIG. 2 shows an electric diagram of a known electric gas-lighter without an electronic filter;

FIG. 4 shows a partial electric diagram of an electric gas-lighter featuring a known electronic filter for reducing electromagnetic noise;

FIG. 5 shows a partial electric diagram of an electric gas-lighter featuring an electronic filter in accordance with the invention;

DETAILED DESCRIPTION OF THE INVENTION

Figure 3:
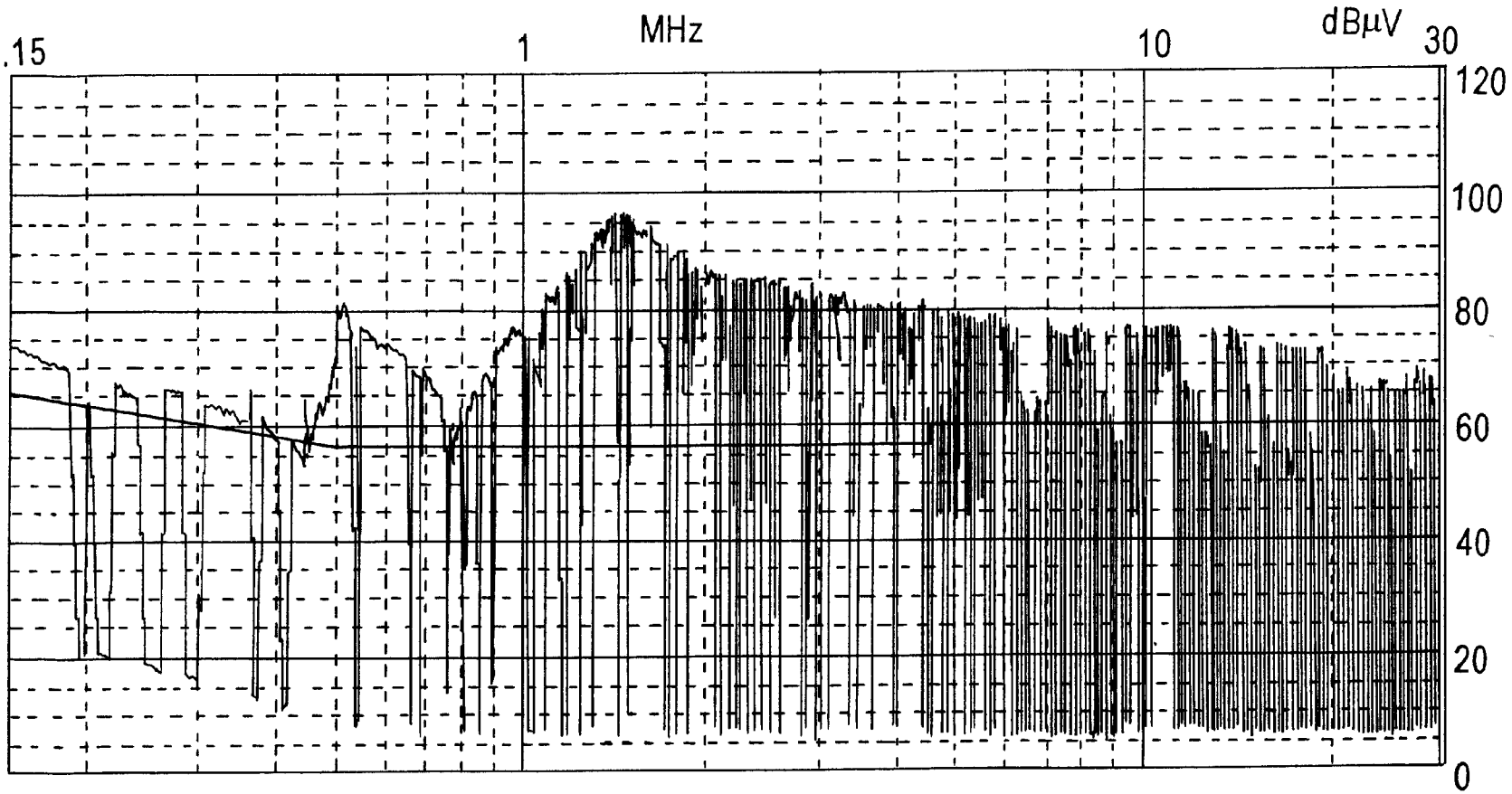
FIG. 3 (PRIOR ART)
FIG. 3 shows the result of an electromagnetic compatibility test of the FIG. 2 gas-lighter.

FIG. 5 indicates an electric gas-lighter 4B featuring an electronic filter 27 in accordance with the present invention.

Electronic filter 27, substituted for filter 20 in FIG. 4, comprises a single capacitor 28, of capacitance C, located between nodes 22. and 23 and having no ground connections; a first pair of resistors 29 located respectively between terminal 7 and node 22 and between terminal 8 and node 23, and preferably having the same first resistance value R1; and a second pair of resistors 30 located respectively between node 22 and the anode of diode 10 and between node 23 and node 13, and preferably having the same second resistance value R2. Resistance values R1 and R2 of resistors 29 and 30 and capacitance C of capacitor 28 are so selected as to regulate the frequency of voltage V2 at the secondary windings and the energy of the discharge producing the sparks.

Figure 6:
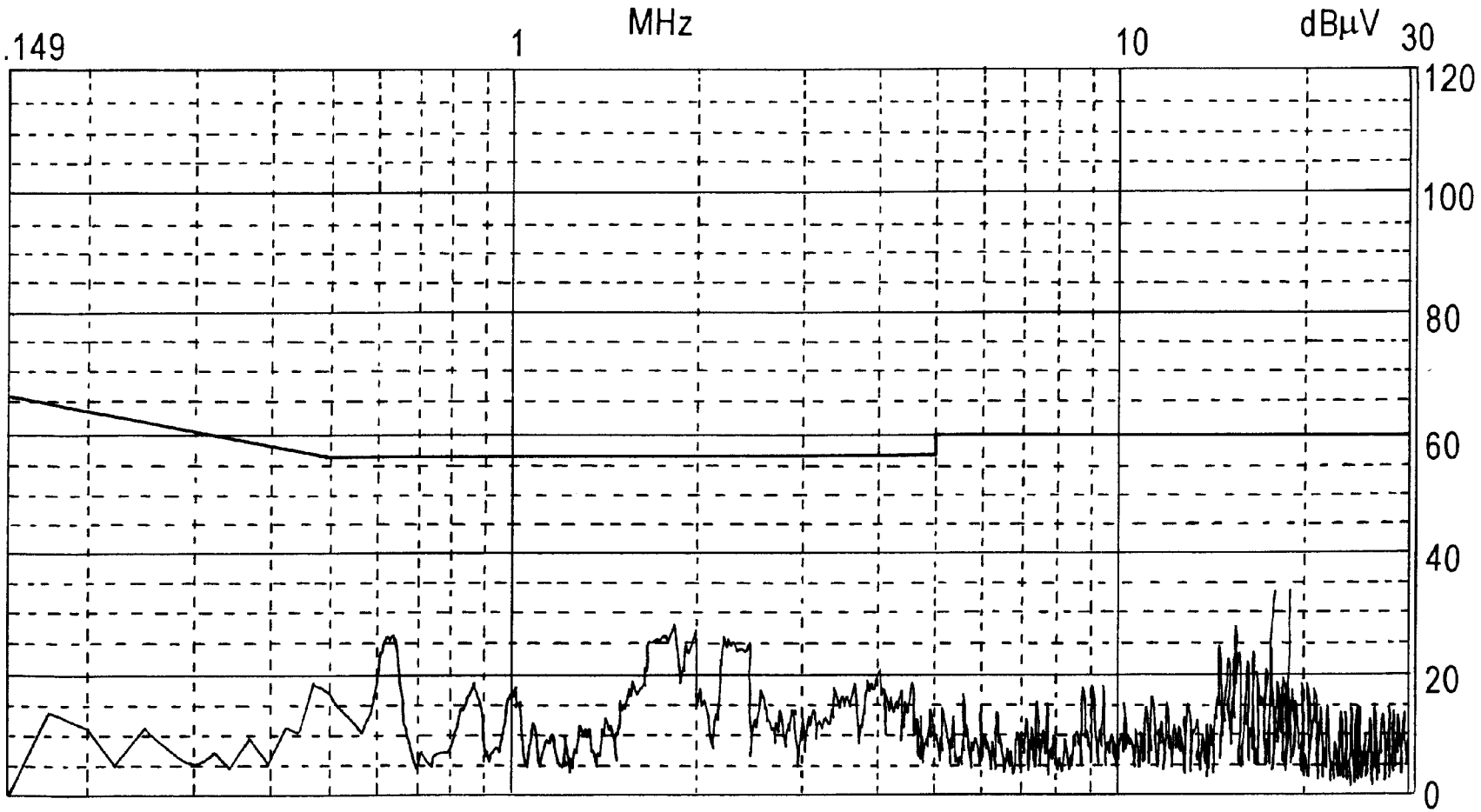
FIG. 6 shows the result of an electromagnetic compatibility test of the FIG. 5 gas-lighter.

FIG. 6 shows the result of an electromagnetic compatibility test of gas-lighter 4*b* to determine, as before, the electromagnetic noise between terminals 7 and 8 during the discharge transient. As can be seen, the noise level is considerably below the prescribed limits.

The advantages of filter 27 according to the invention are as follows.

Above all, filter 27 has no circuit elements (resistors, capacitors, nodes or similar) connected to a reference potential (ground). Eliminating ground connections not only simplifies the gas-lighter but also provides for reducing production time and cost, which, though minimum per unit by eliminating the ground cable, affords considerable saving in mass production terms.

Moreover, eliminating the ground connections eliminates a possible vehicle for the entry of electromagnetic noise.

Clearly, changes may be made to the gas-lighter described and illustrated herein without, however, departing from the scope of the present invention.

What is claimed is:

1. An electric gas-lighter, comprising a filter interposed between a pair of input terminals (7, 8) and a current-discharge generating circuit (5*a*) for generating current discharges and cooperating with at least one output terminal (3) to generate sparks as a consequence of the generation of said current discharges;

wherein said filter (27) has no circuit elements connected to a reference potentials, wherein said filter (27) comprises an energy-absorbing arrangement (28) connected to absorb at least part of the energy generated during said current discharges; a first decoupling arrangement (29) located between said energy-absorbing arrangement (28) and said pair of input terminals (7, 8); and a second decoupling arrangement (30) located between said energy-absorbing arrangement (28) and said current-discharge generating circuit (5*a*), and wherein said first decoupling arrangement (29) comprise a first pair of resistors (29) located respectively between a first (7) of said input terminals (7, 8) and a first intermediate node (22), and between a second (8) of said input terminals (7, 8) and a second intermediate node (23); said energy-absorbing arrangement (28) comprising a capacitor (28) located between said first intermediate node (22) and said second intermediate node (23); said second decoupling arrangement (30) comprising a second pair of resistors (30) located respectively between said first intermediate node (22) and said current-discharge generating circuit (5*a*), and between said second intermediate node (23) and said current-discharge generating circuit (5*a*).

2. A gas-lighter as claimed in claim 1, wherein the resistors in said first pair of resistors (29) have substantially the same first resistance value (R1); and the resistors in said second pair of resistors (30) have substantially the same second resistance value (R2).

3. An electric gas-lighter, comprising a filter interposed between a pair of input terminals (7, 8) and a current-discharge generating circuit (5*a*) for generating current discharges and cooperating with at least one output terminal (3) to generate sparks as a consequence of the generation of said current discharges;

wherein said filter (27) has no circuit elements connected to a reference potential, and wherein said filter (27) comprises an energy-absorbing arrangement (28) connected to absorb at least part of the energy generated during said current discharges; a first decoupling arrangement (29) located between said energy-absorbing arrangement (28) and said pair of input terminals (7, 8); and a second decoupling resistive arrangement (30) located between said energy-absorbing arrangement (28) and said current-discharge generating circuit (5*a*).

* * * * *